United States Patent [19]

Meshi et al.

[11] 4,062,180

[45] Dec. 13, 1977

[54] ELECTRONIC CHESS CLOCK

[76] Inventors: Joseph Meshi, 1514 Traveld Way, Encinitas, Calif. 92024; Jeffrey R. Ponsor, 11230 Calle Dario, San Diego, Calif. 92126

[21] Appl. No.: 600,932

[22] Filed: July 31, 1975

[51] Int. Cl.[2] ..... G04B 5/20

[52] U.S. Cl. ..... 58/145 D; 58/152 R; 58/23 R; 58/50 R

[58] Field of Search ..... 235/92 ST, 92 T, 132 R, 235/132 E; 273/136 A; 58/145 D, 39.5, 145 A, 145 R, 152 R, 153, 50 R, 16.1 R, 38 R, 21.13, 23 R; 340/323

[56] References Cited

U.S. PATENT DOCUMENTS

| | | | |
|---|---|---|---|
| 2,539,754 | 1/1951 | Rettinger et al. | 58/153 X |
| 3,128,373 | 4/1974 | Phlieger | 235/92 T |
| 3,610,753 | 10/1971 | Neubauer | 58/21.13 X |
| 3,686,880 | 8/1972 | Samejima | 58/74 X |
| 3,698,180 | 10/1972 | Klein | 273/136 A X |
| 3,789,195 | 1/1974 | Meier et al. | 235/92 T |
| 3,877,216 | 4/1975 | Mounce et al. | 340/323 X |
| 3,878,675 | 4/1975 | Prociuk | 58/145 D |
| 3,961,473 | 6/1976 | Hung | 58/23 R X |

*Primary Examiner*—Ulysses Weldon

*Attorney, Agent, or Firm*—William F. McDonald

[57] ABSTRACT

A chess clock is provided which is electronic in operation and digital in display having three modes of operation. In the first mode, the *tournament mode,* the display has two digital clock displays in minutes and seconds which indicate the time remaining in any given period for each player, together with the total number of required moves remaining. The total time allotted in each period, and the number of moves are programmable into the clock. The subsequent periods to the primary first period are also programmable into the clock with time remaining in preceding periods automatically added on to subsequent periods. The *fast game mode* is similar to the tournament game with the exception that both times are digitally displayed and not the number of moves since this is not a parameter of the game. A *seconds game mode* is also provided with one *time remaining only* display with a countdown for the number of seconds allowed per each move, typically 10 seconds. This displays only the active player's time remaining since there is also a very short time add-on grace period feature in this mode. Suitable buzz tones indicate time periods elapsed and in the seconds game a preliminary elapsed time together with a grace period lapse is indicated.

7 Claims, 9 Drawing Figures

SECONDARY TIME
SW. ENABLE LINES 220
PRESET SWITCHES
SECONDARY MOVES
PRIMARY MOVES
SW. ENABLE LINES 220
PRIMARY TIME
ARITHMETIC UNIT 201
BCD WRITE BUS 223
MODULO 60 GATES
BCD ADDER
BLOCKING GATES
READ LINES 222
SW. M'PLXR
SW. BUS 221
RDC
TM1/(828)
LTM1
RTM1
(412)
COK
COUT
(650) PHSØ
CNEG
CINOK
(413) ENDSC
(412) MV1
(506) SUB
(209) ONE
ZERO
(726) SET
(531) ADD
(403)
RCD3
RCD2
RCD1
RCDØ
(402) (650) (801) WCD3
(402) (650) (801) WCD2
(402) WCD1 (650) (801)
(402) WCDØ (650) (801)
EST2
EST1
ESTØ
ESM1
ESMØ
EPM1
EPMØ
EPT2
EPT1
EPTØ
(404)

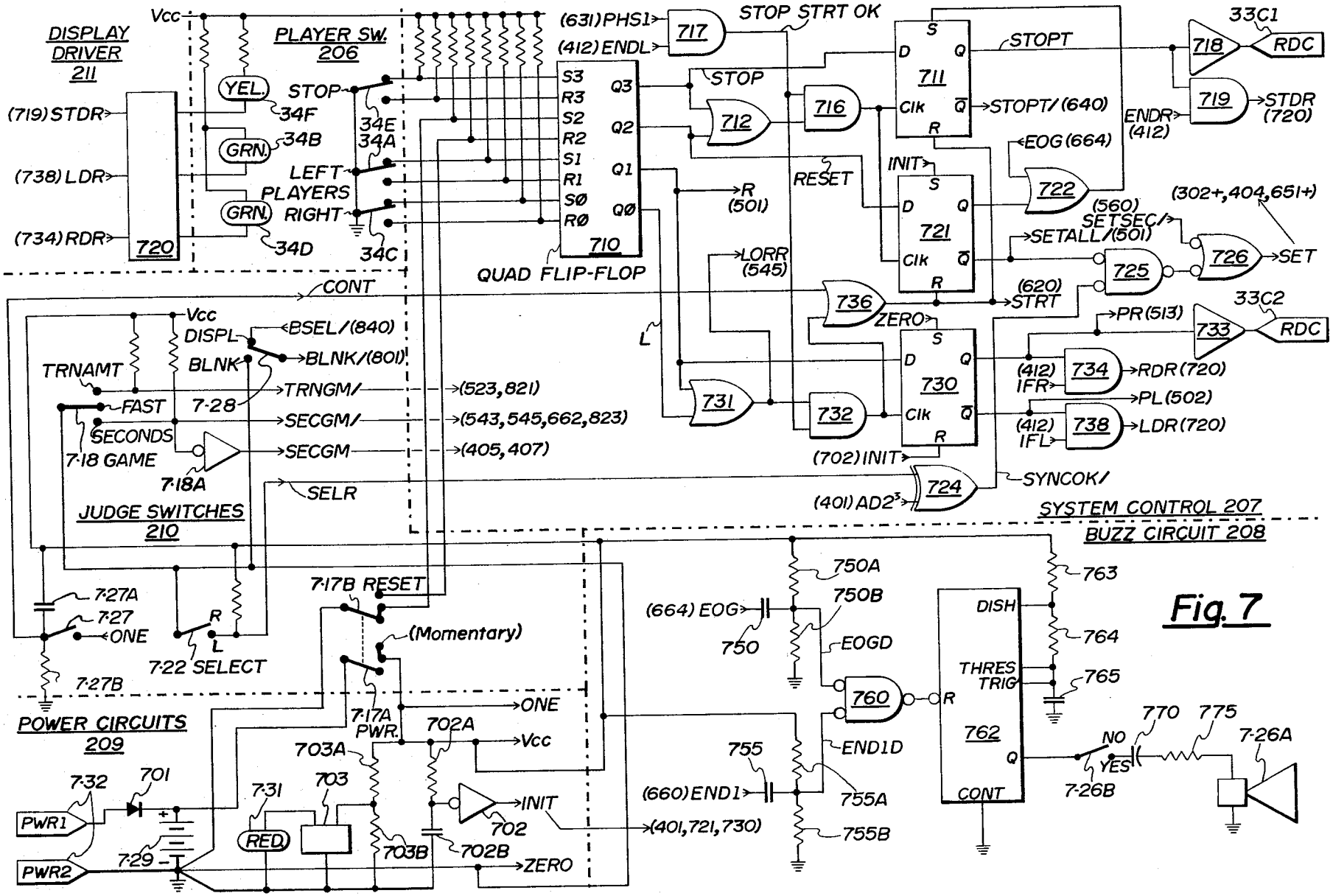
Fig. 7
SYSTEM CONTROL 207
BUZZ CIRCUIT 208
QUAD FLIP-FLOP
710
PLAYER SW. 206
DISPLAY DRIVER 211
JUDGE SWITCHES 210
POWER CIRCUITS 209
STOP STRT OK
STOPT
STOPT/(640)
EOG (664)
ENDR (412)
STDR (720)
RDC
33C1
33C2
(302+,404,651+)
SET
SETSEC/
SETALL/(501)
(560)
(620) STRT
PR (513)
RDR (720)
PL (502)
LDR (720)
(412) IFR
(412) IFL
SYNCOK/
(702) INIT
(401) AD2³
INIT
ZERO
RESET
STOP
R (501)
LORR (545)
(631) PHS1
(412) ENDL
(523, 821)
(543, 545, 662, 823)
(405, 407)
BSEL/(840)
BLNK/(801)
TRNGM/
SECGM/
SELR
CONT
DISPL
BLNK
FAST
SECONDS
TRNAMT
(719) STDR
(738) LDR
(734) RDR
Vcc
DISH
THRES TRIG
CONT
EOGD
END1D
(664) EOG
(660) END1
(401, 721, 730)
(Momentary)
RESET
ONE
PWR.
SELECT
PWR1
PWR2
YES
NO
YEL.
GRN
RED

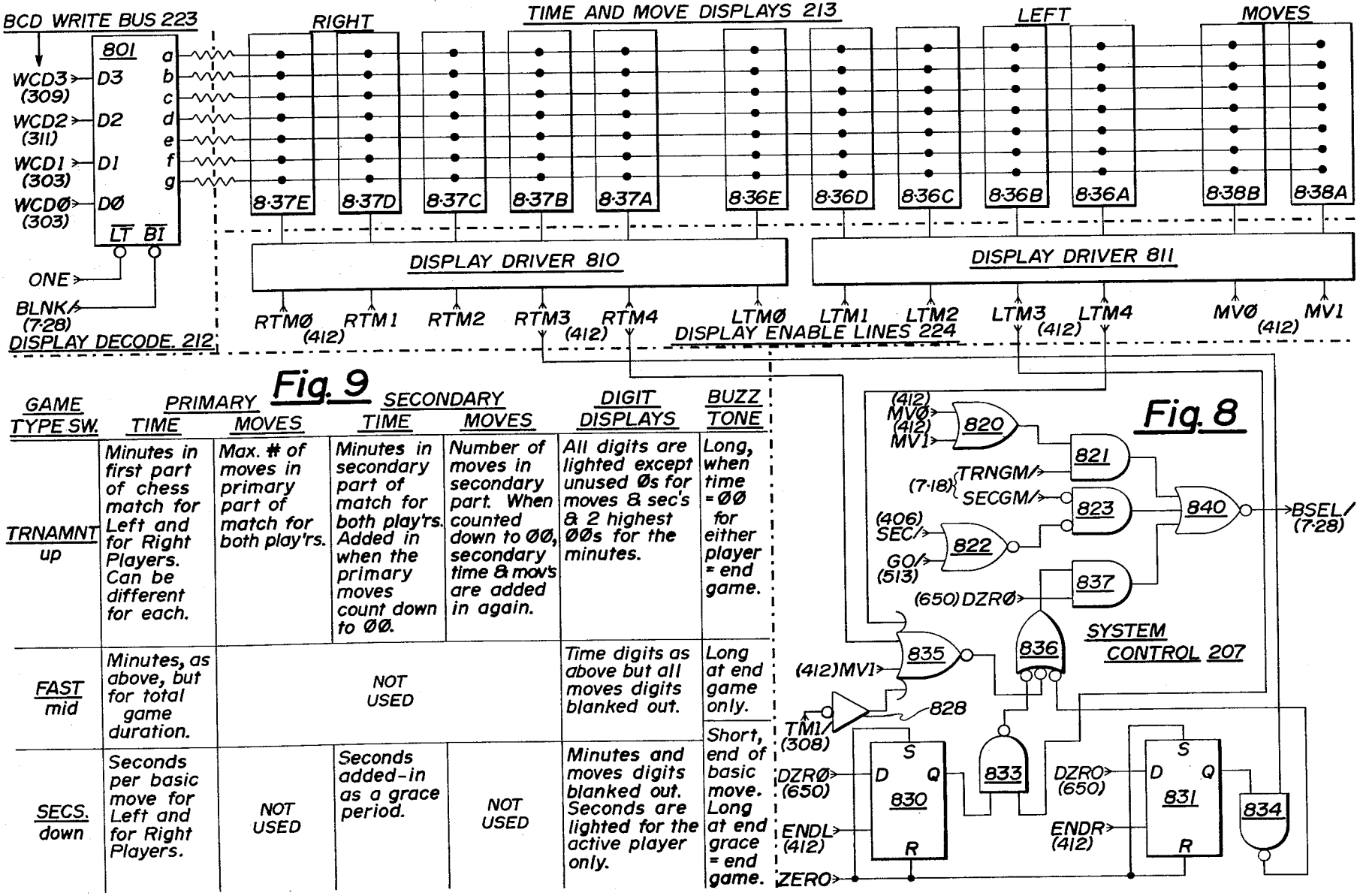

Fig. 8

Fig. 9

| GAME TYPE SW. | PRIMARY TIME | PRIMARY MOVES | SECONDARY TIME | SECONDARY MOVES | DIGIT DISPLAYS | BUZZ TONE |
|---|---|---|---|---|---|---|
| TRNAMNT up | Minutes in first part of chess match for Left and for Right Players. Can be different for each. | Max. # of moves in primary part of match for both play'rs. | Minutes in secondary part of match for both play'rs. Added in when the primary moves count down to ØØ. | Number of moves in secondary part. When counted down to ØØ, secondary time & mov's are added in again. | All digits are lighted except unused Øs for moves & sec's & 2 highest ØØs for the minutes. | Long, when time = ØØ for either player = end game. |
| FAST mid | Minutes, as above, but for total game duration. | NOT USED | | | Time digits as above but all moves digits blanked out. | Long at end game only. |
| SECS. down | Seconds per basic move for Left and for Right Players. | NOT USED | Seconds added-in as a grace period. | NOT USED | Minutes and moves digits blanked out. Seconds are lighted for the active player only. | Short, end of basic move. Long at end grace = end game. |

ELECTRONIC CHESS CLOCK

BACKGROUND OF THE INVENTION

In most chess tournament games, each player faces essentially two opposing forces — his opponent and time. Time plays a critical role in the conduct of the game since it is usually desired to conclude any contest within a realistic period. It is well recognized that time is a major factor in the game of chess, and several variations of the game have been evolved, placing critical priorities on this factor.

One style of chess in which time is of no great significance is postal chess, in which moves are communicated between players through the mail or similar slow channels. The chess clock has no place in this environment. It usually assumes its primary role when used by a pair of players who face each other over a single chess set, in a singular location, ready to play to a checkmate.

The clock thus assumes two major functions. It provides an equal (unless otherwise mutually agreed upon) period of thinking time to each player, and it also restricts the thinking time to a manageable length. This second criteria is of real importance in a tournament environment, where the total length of time available for the conduct of the affair is limited to several days, such as a weekend.

The game of chess is typically played between two opponents (white and black) who make alternate moves in turn until one of the following conditions occurs:

1. One player checkmates the other (or accepts resignation).

2. A draw is agreed upon or is forced.

3. One player runs out of time. Condition "3" is, of course, applicable only in the event that a time limit game is being played.

The general class of chess games in which time plays a significant role may be divided into three distinct categories. The following is a description of each category.

1. *Tournament style game.* Although tournaments are arranged for all three categories, this game is by far the most commonly played in competition meets. The time portioned each player is divided into periods. The initial (or primary) period is typically about 2 hours long. In these 2 hours, the player is expected to perform a given number of moves (typically about forty). Thus, if each player used the maximum amount of time allowed during the primary period, the real time elapsed would be close to 4 hours. If one of the players runs out of his allotted time before completing the required number of moves, he loses automatically regardless of the board situation. Once a player has performed all his required moves within the primary period, he is allotted additional time (the secondary period) to perform an additional number of moves to be played out in an additional hour.

By completing the primary period's required number of moves, any time left over is added to each player's secondary period. Thus, in the aforementioned example, if white completes his fortieth move in exactly one hour, his secondary period is increased by his unused primary period hour. This process is repeated until a final resolution has been achieved. It is important to note that each player's thinking time is measured separately, thus a player consumes no time while it is his opponent's turn to play.

The typical tournament style game lasts approximately 4 hours, and it is quite common to find players under severe time pressure toward the end of their primary time period, having to complete several critical moves within a small number of minutes.

2. *The short game.* This game style is in reality only a subset of the standard tournament game. Time is afforded a higher premium, and its relevance to the game becomes almost as important as the opposing player. Each side is allotted a single time period, typically 5–10 minutes, during which it can make an unlimited number of moves, but must also conclude the game naturally (checkmate or draw). Since there is no secondary period, the game also ends when any of the players runs out of time, regardless of board position. In this game style, it is not unusual to find a player in a hopeless board position, hanging on to the game in anticipation of seeing his opponent running his clock out. A common occurrence in this game is seeing both players exhaust their allotted few minutes, and the winner undetermined, as a consequence of their own intense concentration.

3. *The seconds game.* This game is the fastest moving form of chess. Each player is allowed a set number of seconds, e.g., 10 seconds, to think between any two moves, for an unlimited number of moves. Time is of extreme importance since a player must move within 10 seconds of his opponent's last move, or lose regardless of board position. It is customary to allow each player a couple of seconds grace at the conclusion of his think period, however, a prior art mechanism does not exist that would automatically end the game when a player really overshoots his allotted seconds.

PRIOR ART

The chess clock currently in use was devised in about 1900 by a Dutchman named Veenhoff. In the past 75 years there has not been any significant change in the conceptual or practical design of the time piece.

Hence, this existing design was conceived to perform the following fundametal functions:

1. Provide each player with an accurate measure of the amount of time both players have left to use.

2. Provide an impartial judgment of termination of a think period for each player.

3. Indicate to both players whose time is being run. The prior art chess clock is typically a casing enclosing a dual mechanism which is toggled manually. The two mechanical (spring wound) clocks face the same direction, and are calibrated exactly as a standard twelve-hour clock. The various external features of the clock include:

A toggle switch when pressed activates the opponent's clock and stops its own. Also, when pressed it will raise the other toggle switch. Thus, a raised switch indicates to a player who happens to be some distance from his table, whose turn it is to play. This switch typically protrudes ⅜ when fully extended.

An hour hand traverses 30° per hour. It is used to indicate the gross level of the time remaining. In a typical tournament game, it is set at either 4:00 or 10:00, so that the primary period will end at either 6:00 or 12:00 (no standard exists.) The hour hand is useless in the fast or 10-seconds games.

A minute hand rotates 360° once every hour, thus crossing the 12:00 mark once every 60 minutes. In a 2-hour primary period game, the first crossing is not material, but the second one is. The minute hand is set manually to its desired initial point, which most typically is in the 12:00 mark.

A running time indicator provides a position indication of activity through its own movement. Thus, by looking at the face of the clock, each player may ascertain whose time is being expended.

A flag which is raised to an almost horizontal position by the passing minute hand, thus providing a clue as to the remaining time. At supposingly exactly 12:00 the flag drops back to the vertical position, released by the continuing movement of the minute hand, thus signaling rather positively the termination of a set period.

The clock face is identical to the familiar time clock in every respect.

The clock housing is typically about 6 × 3 × 1.5, quite light weight, and portable.

The back of the casing carries most of the salient switches, including an hour hand set, a minute hand set, a winding key, and clock speed adjustment levers.

In any game that a clock is used, *Black* initiates the game by depressing his toggle switch. The clock action is the official instant of the game commencement. *White* then, following a period of thought, depresses his switch, thus putting the burden of time on *Black*, and so on. The number of moves played is kept track of by the actual record of the game (written move by move by no less than one of the players).

DISADVANTAGES OF THE CURRENT CHESS CLOCK

The currently used clock has several disadvantages, some of which have provided ground for disagreements and debate ever since its inception.

1. Since it is basically a mechanical device, the current chess clock is quite noisy. It is especially pronounced in the quiet environment in which most games are played. The chess clock ticking is commonly the loudest sound in the room.

2. Because of the clock's location, it is difficult to read the precise time, especially during the final few moments of a playing period. The sharp angle between each of the players and the clock requires the interested player to literally recline over the board to avoid parallax, or to lift the clock to himself, a move disallowed in most circles since it can cause errors or a premature dropping of the flag.

3. The clock may be quite inaccurate. It is not uncommon for the flag to fall while the minute hand is visible on the short side of the hour. Also, during the final few seconds (really tens of seconds), no player can obtain an accurate value of his time remaining. In a fast game this is critical, while in the tournament game it is also of great significance.

4. The falling of the flag may go unnoticed by either one of the players, or any one of them. The ethical question of whether a player whose flag has fallen should alert his opponent to that fact, has been a source of many debates for decades. As indicated before, it is quite possible to have a situation in which both players were so engrossed in the game that both flags were dropped unnoticed by either player.

5. The current clock is completely inadequate for the ten seconds game. It simply does not have any mechanism to handle that game. Timing for the 10 second game is usually kept by a single master timer (clock) that emits an alarm at the conclusion of every ten second delay. The acting player must remove his hand from the piece that he just handled, at the final instant of the buzzer. There is no mechanism, however, to judge whether he was within or out of time (or to penalize him if he was at default).

BRIEF DESCRIPTION OF THE INVENTION

The new electronic chess clock of the present invention was designed to incorporate all the critical functional features of the mechanical clock, eliminate the disadvantages and provide for features previously not attained.

1. The clock displays time remaining in any period for each player; the clock counts down, since it is important for the player to rapidly assess the amount of time he has remaining in the particular period that he happens to be playing in.

2. Time remaining is displayed in a digital format, thus allowing the player an instant readout within reasonable viewing angles and distances.

3. The time displayed also includes an accurate digit for seconds and also a digit for tens of seconds. Thus, the total display for each player will allow both players to pinpoint the time remaining to within one second.

4. The clock's system will include a buzz tone that will provide an audible clue to certain events such as beginning of "grace" period, and end of a time forfeited game. The buzz tone may be shut off if any one of the players is disturbed by it.

5. In the event that a player exhausts his allotted time without completing the specified number of moves, the clock, among other things, provides a positive notice of the event by ceasing to keep time.

6. The clock provides for the timing of a seconds game by a short buzz tone at the end of the selected number of seconds per move and unless a move is made, a long buzz tone at the end of a selected number of seconds of "grace" which terminates the game.

7. The clock provides a timing mechanism for any of the three types of chess games previously described, i.e., the standard tournament game, the short time game, and the seconds game.

8. In addition to displaying remaining times and required moves, the clock provides semi-automatic SET function which initially enters time and moves allowances agreeable to both players; a fully automatic subtract SUB function which decrements the time and moves allowances as seconds pass and moves are used up; and an ADD function which automatically effects the entry of additional secondary time and moves allowances as agreed to between players before the start of the match.

9. An address sequence system is provided for sequencing power to each of the digital readout digits at a frequency above a visual perception threshhold frequency, i.e., a blanking cannot be observed. This reduces battery drain a significant amount.

BRIEF DESCRIPTION OF THE DRAWINGS

FIG. 7 is a detailed circuit logic diagram of player switches, judge switches, power circuits, buzz circuits, a displayer driver and yet another part of the system control portion of the functional block diagram of FIG. 2;

FIG. 8 is a detailed logic circuit diagram of the display decoder time and move display, display drivers, and a still further part of the system control of the functional diagram of FIG. 2; and FIG. 9 is a chart of various performance functions for each of the three types of programmable games.

DETAILED DESCRIPTION OF THE DRAWINGS

Figure 1:
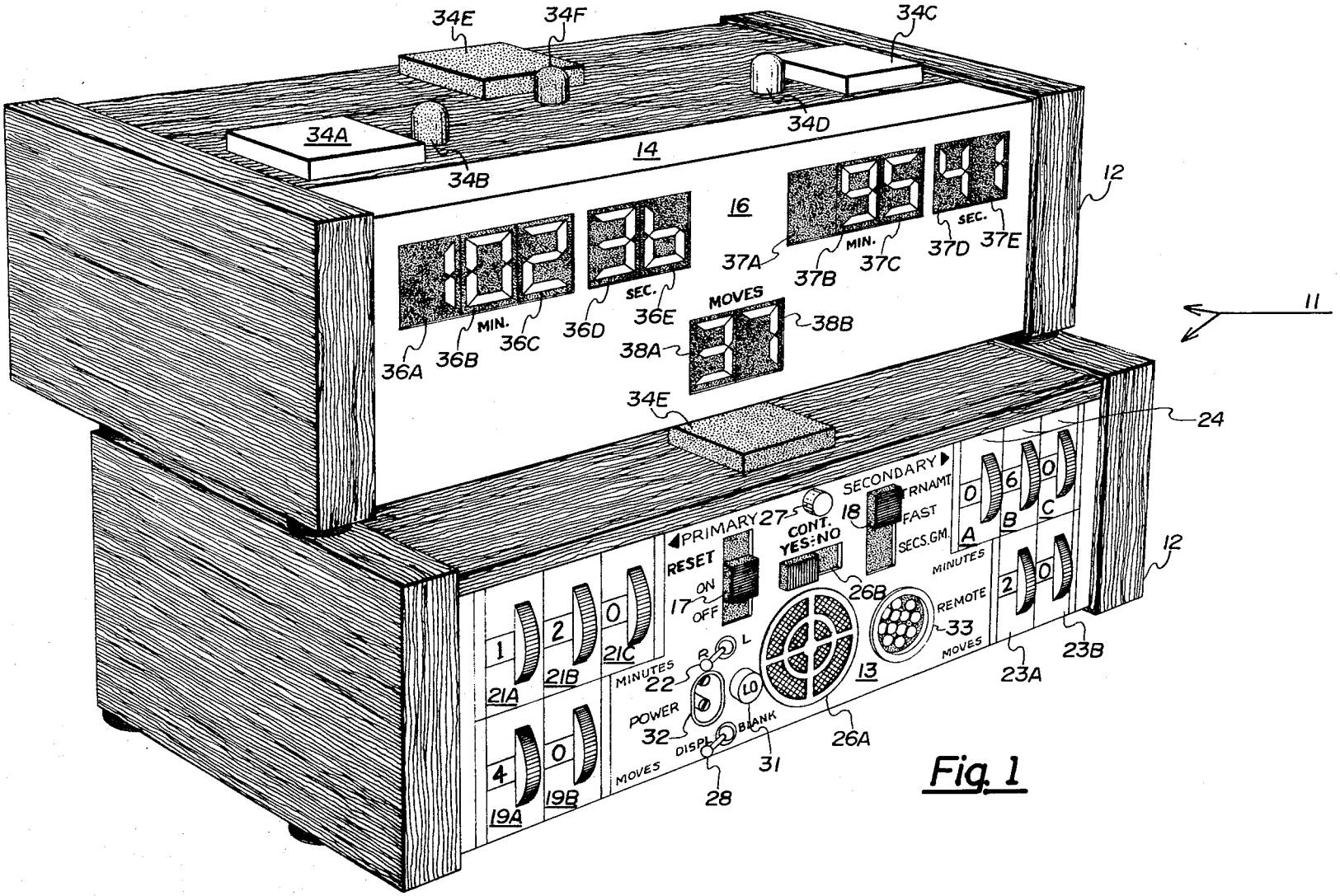
FIG. 1 illustrates two stacked perspective views of the preferred embodiment of the present invention.

FIG. 1 presents the man-machine interface of a game programmable chess clock 11 from two views; the upper being the front of the clock unit and the lower being the back which is presented only to the judges of a chess match. The basic enclosure 12 is provided with a back pre-game input panel 13, an upper player input panel 14, and a front progress display panel 16.

Pre-game programming starts on the back panel 13 at off-on-reset switch 17, a double pole, triple throw switch, with an upper, momentary position designated "reset." At the end of a preceding chess match switch 17 was switched to the lower *off* position; programming begins by switching it to the *on* position, which initializes all internal computing hardware. The type of game to be played is then entered by means of game-type switch 18. Typical game formats are depicted by FIG. 9, but for this initial discussion the format will be the tournament game to which the switch is positioned.

Players select on which side of the clock they will sit, clock to right or clock to left, and they also match or draw for first move. They further agree on the time duration and the number of moves which will constitute the first or primary part of the match. Primary moves are entered on thumb-wheel switches 19A for the most significant digit and 19B for the least significant, and the same number applies to both players. Primary time is entered on thumb-wheel switches 21A, 21B and 21C. By means of a select R or L switch 22 the present time, e.g., 120 minutes, is memorized for a player, e.g., *Right*, and is automatically set in. If player *Left* is to be governed by the same time entry, it is only necessary to toggle switch 22 to the L position. Player *Right's* previous entry is held in memory. If L is to be given added time as an incentive for a weaker player, or, if L's time is to be less than R, a new entry for L can be entered on switches 21A, 21B and 21C. Time for either player may be entered first, and is set-in automatically as above when clock 11 has just been turned on. The reset position of switch 17 can be momentarily touched to start the set-in of a second game or to reset the numbers for both players.

Players further agree to the duration and number of moves which will constitute the secondary part of the match. These numbers which pertain to both players are entered via secondary moves switches 23A and 23B; for time, the entry is made via thumb-wheel switches 24A, 24B and 24C.

Additional provisions are made on back panel 13. A tone speaker 26A informs the players of two different critical game situations (see FIG. 9) but this warning tone can be shut off at bell switch 26B if it disturbs a player's concentration. Should the players desire, the game can be stopped for a judge's decision, for lunch, or for any reason. Play is resumed by momentarily depressing a continue switch 27. If play is stopped for a significant time, blanking switch 28 may be moved from "display" to "blank" to blank out all data on front panel 16 and reduce the drain on internal batteries 29 (not visible) within enclosure 12. A red, *battery low LED* indicator 31 turns on before battery power is reduced to a dangerous level. Batteries 29 may be restored to full charge or the entire match record can be powered by an external charger (not shown) which may be plugged into power connector 32. Provision is also made via remote display connector 33 to relay signal voltages pretaining to game progress for external use.

Players share a view of the front panel 16 which is normally to one side of the chess board. Before the game starts there is no indication of which player is white and which is black. There is only a left player's switch 34A and an accompanying green, left LED indicator 34B and a right players switch 34C with a green right LED indicator 34D. There is also a stop switch 34E with a yellow LED indicator 34F by which either player or a judge may stop the running time. LED's are on only when the switch adjacent to them is an active position. Left and right become white and black players only when the player who loses the toss (the black player) presses his button. The opposite player is automatically designated as white for the remainder of the game. White's indicator LED is lit and his time begins to run down.

Before play commences, left and right primary times are shown on the front panel 16. Since the numeric displays, like player switches 34A and 34C, can be either for white or black, they can be physically identified only as left time displayed digits 36A, 36B, 36C, 36D and 36E, and right time digits, 37A, 37B, 37C, 37D and 37E. Time in either of these displays decrements only when its players LED is lit, thus only one display is counting down at any time. For convenience of reading, the most significant minutes digit is blanked out when it would normally show zero, and the next significant digit is also blanked out after it is counted down to zero. The same type of blanking occurs with the most significant second and the most significant moves digit. Moves remaining appear on move display digits 38A and 38B and these decrease by one point only when Black's switch is closed since moves in chess are always noted by the pair.

Figure 2:
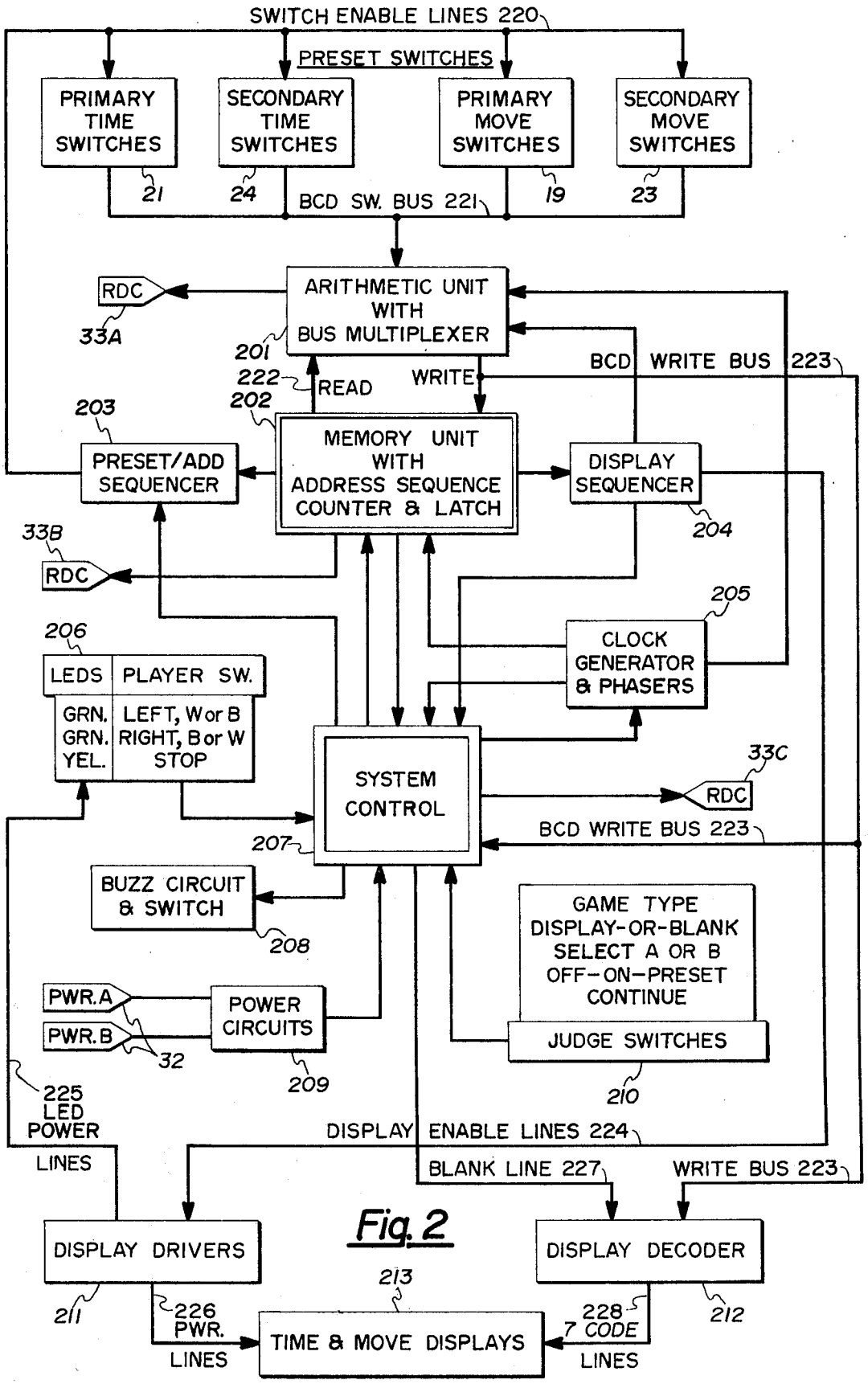
FIG. 2 is a functional block diagram of the embodiment of FIG. 1.

FIG. 2 illustrates a functional block diagram. At the top are the four groups of preset switches 19, 21, 23 and 24 which appear on the back panel 13 of FIG. 1. (New internal functions are numbered from this point on with three digit numbers, the first digit being the number of the figure on which that function or device first appears.) Outputs of these switches are available when they are energized via enable lines 220 and the outputs are routed via BCD switch bus 221 to an arithmetic unit 201 which also receives and processes BCD read signals from read line 222. Signals on both lines are sequentially multiplexed and processed to create BCD outputs on BCD write bus 223 which routes updated match status signals to other functional blocks including memory unit 202.

The memory unit includes a buffer latch to stabilize the BCD read signals going out on line 222 and a 16 position binary address sequence counter which controls the sequential action and multiplexing of the entire clock 11, and directly drives a preset/add sequencer 203 which sequentially routes enable voltages to the preset switches 19, 21, 23 and 24, when needed. The same address sequence counter contained within memory unit 202 directly drives a display sequencer 204 which sequentially enables every digit of the displays on front panel 16 and top panel 14. At no time is there more than one display digit or indicator LED receiving power but the sequential scan rate is so swift that no blinking is discernable. That scan rate and the slower source for pulses every second come from a block generator with phasers 205 where the high clock rate is divided into three sequential phases, which are used to program signal pulses through the computing gates. Outputs flow to the arithmetic unit 201, to the memory unit 202, and to a system control 207 which receives and routes all inputs and instructions that control the operations of the unit. One of the outputs is to the remote display connector segment 33C which with 33A (from the arithmetic unit 201) and 33B (from memory unit 202) comprise the remote display connector (33) of FIG. 1.

The functions of the player operated switches 206 are fed into system control 207 as also are the functions of the judge switches 210 which are physically located on the back panel 13 (FIG. 1) and internal power circuits 209 which also connect with power connector 32.

Display enable lines 224 route the sequenced outputs from display sequencer 204 to a series of display drivers 211 from which LED power lines 225 go to the stop and players LEDS of 206 and power lines 226 go to each display panel of time and move displays 213. Write bus 223 routes BCD data from arithmetic unit 201 to a display decoder 212 which also receives digit blanking information on blank line 227 from system control 207 and converts the BCD data to a seven segment coded equivalent which is routed to all display panels of time and move displays 213 via 7 code lines 228.

Specific internal hardware logic elements within the chess clock 11 are organized in a general sequence, reading down the clock diagram of FIG. 2. Dot-dash separating lines are used in FIGS. 3 through 8 to indicate lines of demarcation between the logic elements of one functional block and those logic elements of another adjacent functional block. Where space permits, the name of the block and its number are shown and underlined near the lines of demarcation. Important signal lines between logic elements are identified by mnemonic letter groups to designate function. Whenever special signal functions must be routed from one figure to another they are coupled with a bracketed number designating the logic element where they originated (if incoming), or to which they are routed (if outgoing). Where logic elements have been previously identified in FIG. 1 by a two-digit number, they retain that number in the detailed FIGS. 3 through 8, but it is often prefaced by the number of the figure where its equivalent electronic or logic symbol appears and by a short dash, e.g., 3-21.

Figure 3:
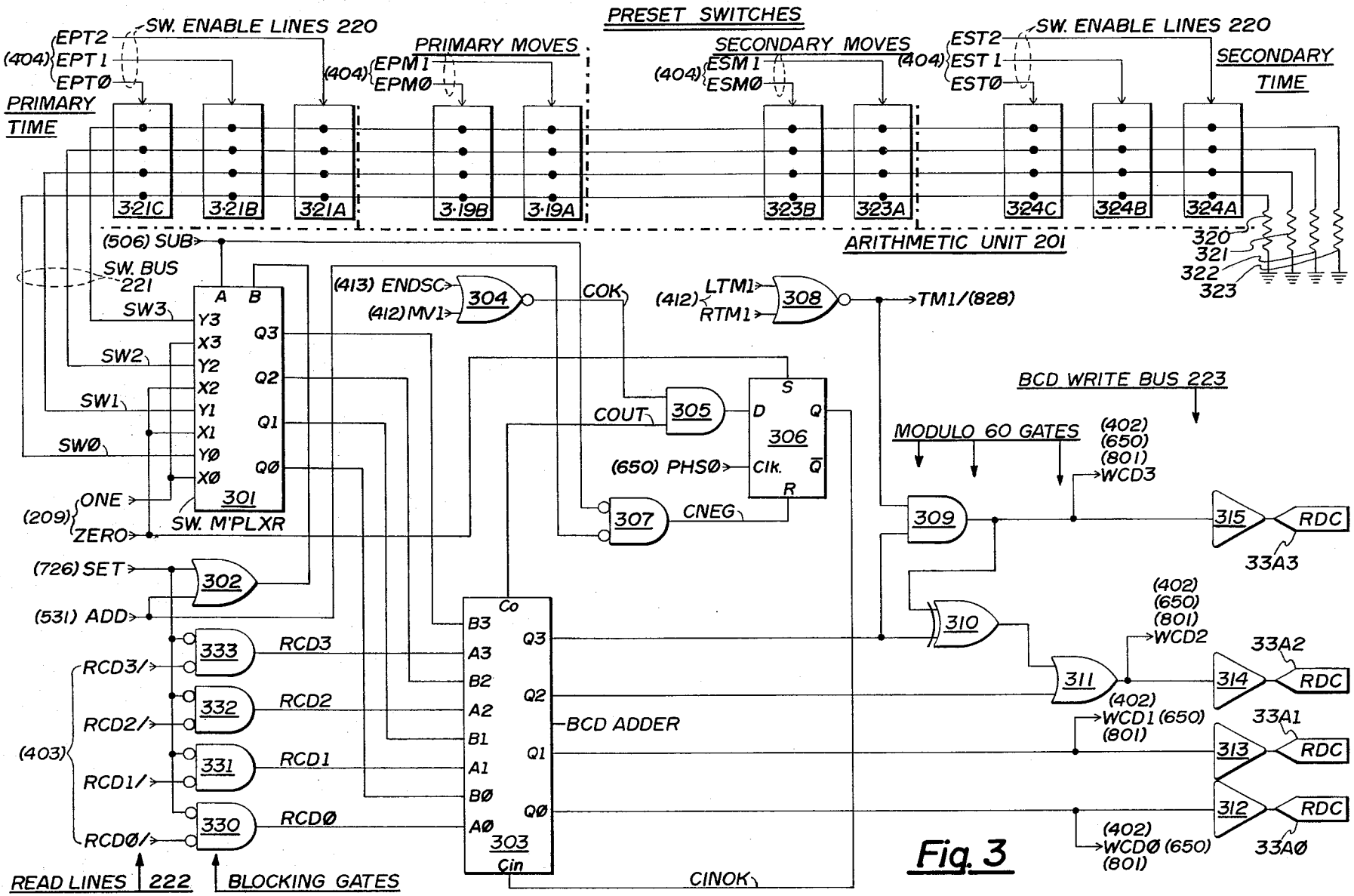
FIG. 3 is a detailed logic schematic representation of preset switches and the arithmetic unit of FIG. 2.

With reference to FIG. 3, the preset switches 21, 19, 23 and 24 of FIG. 2 are viewed from the back. Primary time switches 3-21A, 3-21B and 3-21C representing the most significant, next significant, and least significant digit, respectively, are enabled by lines originating elsewhere, EPT 2 (enable prime time) EPT1 and EPT0, respectively, which are a part of the switch enable lines 220. In similar fashion, primary moves switches 3-19A and 3-19B are enabled by lines EPM1 (enable prime moves) and EPM0; secondary move switches 3-23A are enabled by ESM1 (enable secondary moves) and ESM0; and secondary time switches 3-24A, 3-24B and 3-24C are enabled by EST2 (enable secondary time), EST1 and EST0, respectively. All ten enable lines fully constitute switch enable lines 220. All switches referred to in FIG. 3 are parallel connected by lines SW3, SW2, SW1, and SW0, representing the $2^3$, $2^2$, $2^1$, and $2^0$ binary values of the BCD (binary coded decimal) outputs of each switch and together comprising the BCD SW bus 221. All SW lines are connected to ground by 47k resistors, 323, 322, 321 and 320, respectively, and line values are therefore zero until a switch imposes a signal voltage on a line by first having internal contacts set to inter-connect a bus line with a swith enable line and by secondly having a signal voltage on that specific enable line.

Approximately every 1/6,000 second one of the enable lines can receive a signal. These input signals, when present, sequentially move from one to another of the switch enable lines 220 in the following pair of interrupted sequences: - - EST0, EST1, EST2, -ESM0, ESM1 or - -EPT0, EPT1, EPT2, -EPM0, EPM1. The dashes in the sequence represent 1/6,000 second periods when none of the lines carry a signal voltage. Thus, a sequence of BCD switch values are presented as parallel data on SW0, SW1, SW2 and SW3 lines where they contact Y0, Y1, Y2 and Y3 inputs of preset switch multiplexer 301 within arithmetic unit 201. Signals one and zero which are sourced in the power circuits 209 (see FIGS. 2 and 7) are hard-wire routed to inputs X0, X3, X1 and X2 of preset switch multiplexer 301 to create a permanent BCD=9 or 1001 binary signal on those contacts whenever the chess clock 11 is operating. The outputs Q0, Q1, Q2 and Q3 of multiplexer 301 can therefore receive inputs X0, X1, X2 and X3 (BCD=9) when terminal A is high or they can receive inputs Y0, Y1, Y2 and Y3, when terminal B is high. If both terminals A and B are low there will be zero outputs on all Q terminals of multiplexer 301. Terminal A is high when the system is in a subtract mode, signified by high signal SUB which originates elsewhere and terminal B is high when the system is either in a SET mode or an ADD mode signified by one of those signals at an input terminal of Or Gate 302. Thus, either BCD switch data (Y0 through Y3 of 301), a BCD=9 (X0 through X3 of 301) or zero signals can be routed to (Q0 through Q3 of 301) and thence to inputs B0 through B3 of BCD adder 303.

A carry out COUT signal appears on the Co terminal of BCD adder 303 whenever the sum of two added decimal digits exceeds BCD=9. Such a carry 1 needs to be added to the next higher decimal digit of a sequence of numbers to permit proper addition. When there is a sequential change from looking at time digits to looking at move digits (notice signal sequence, FIG. 4), a carry 1 must be squelched. This is done by combining the COUT signal with a COK signal from Nor Gate 308. The COK signal is low and is untrue whenever the system is scanning or sequencing past the largest move digit, MVI or is looking at the end of a time digits scan ENCSC and it prevents passage of COUT through And Gate 305. A COUT with a high, true COK passes through And Gate 305 and enters the D-for data terminal of D-Flop 306 where it appears on output Q as soon as a PHS0 clock pulse arrives at the CLK terminal unless a high signal CNEG appears on terminal R to negate the output. The COUT is negated by a high signal CNEG from Neg And Gate 307 whenever the system is not in a subtract, SUB mode, or not in an ADD mode. Whenever a carry out, COUT signal is not blocked at And Gate 305 or negated from Nor Gate 307, it becomes a CINOK signal which is carried in at Cin terminal of BCD adder 303.

By means of Nor Gate 308, And Gate 309, Excl Or Gate 310, and Or Gate 311 any BCD=9 number emerging from BCD adder 303 during the scanning of LTM1 or RTM1 (the most significant seconds digit for either player) is not transmitted but is modified or faked to a BCD=5. Although BCD adder 303 is operating as a modulo 100 device and will subtract 1 minute and output 99 seconds after counting down or decrementing to 00 seconds. The modulo 60 Gates change the 99 output to 59, and when the most significant second digit is 5 or less, they are transparent and make no changes to the 303 adder outputs: Q0 = (Write Coded Data) WCD0, Q1=WCD1, Q2=WCD2 and Q3=WCD3; these four signal lines comprise the BCD write bus 223. The same four signal lines also contact N channel buffers 312, 313, 314 and 315, respectively, to provide low drain pin connections 33A0, 33A1, 33A2 and 33A3 for remote display connector 33.

Read lines 222 are specifically identified as (read coded data) RCD0/, RCD1/, RCD2/ and RCD3/ which are input-connected at the lower left of FIG. 3, to Negative And Blocking Gates 330, 331, 332 and 333, respectively. These blocking gates prohibit transmittal of read coded data on read lines 222 whenever the system is operating in SET mode as indicated by the SET signal originating elsewhere. When the SET signal is not present, the read lines 222 are inverted by the blocking gates and contact their respective A terminals of BCD adder 303.

Except for once every pair of moves, once every second, when primary time data is being set into the system or when secondary time data is being added into the system, the read coded data on read lines 222 moves unchanged through BCD adder 303 and emerges as write coded data on BCD write bus 223. The three modifying actions of arithmetic unit 201 including the BCD adder 303; SET, SUBtract, and ADD are detailed toward the end of this section after origins for those signals are explained.

Figure 4:
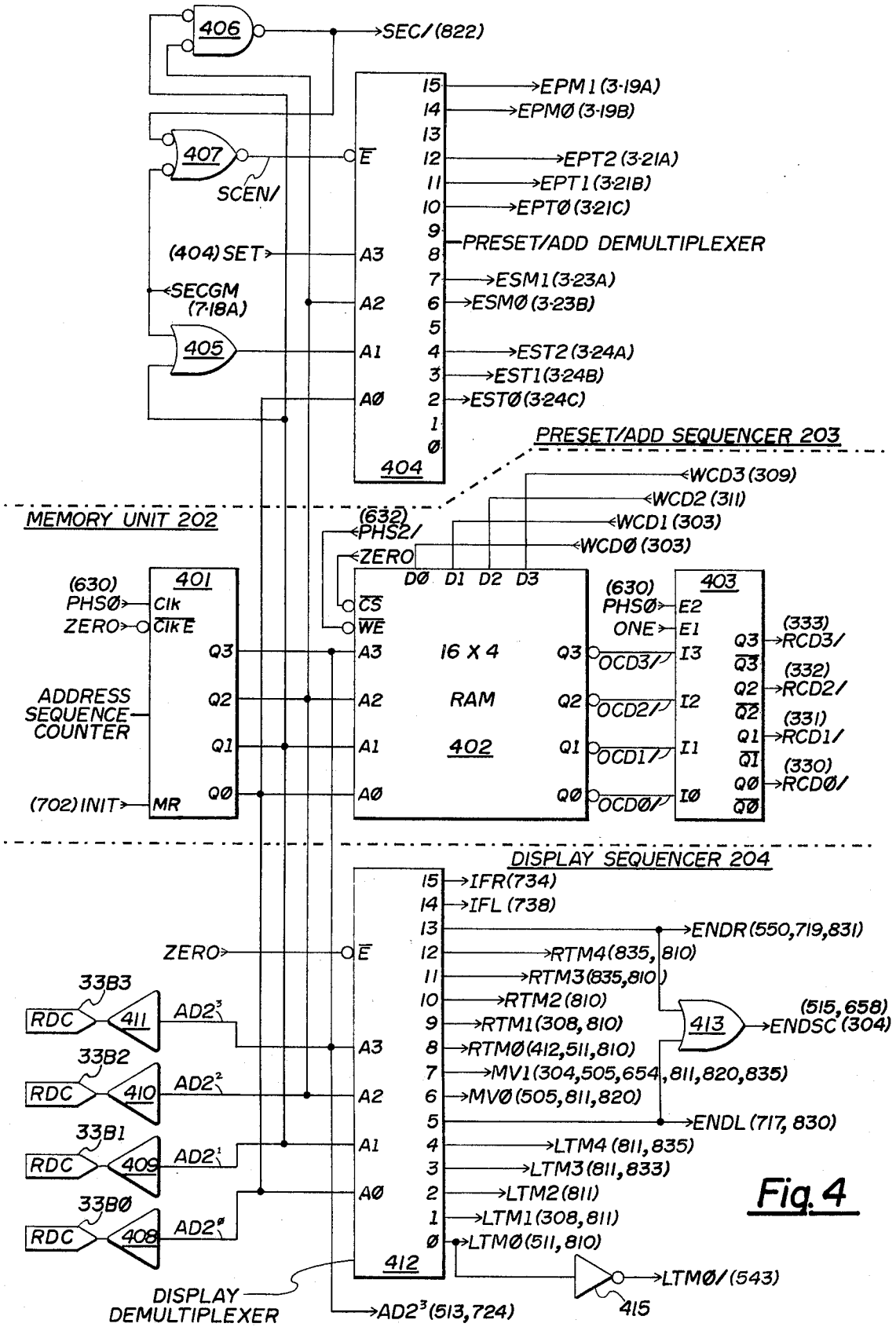
FIG. 4 is a detailed logic circuit diagram of the memory preset add sequencer and display sequencer of the embodiment of FIG. 2.

All significant system data is continuously recorded in memory unit 202 shown detailed in FIG. 4. Address sequence counter 401 is initialized at terminal MR to a 0000 binary number signal on Q3, Q2, Q1 and Q0 outputs by a high momentary INIT signal generated in power circuits 208 when the system is first turned on. A low ZERO signal from the same source continually enables the unit at $\overline{\text{C1kE}}$ terminal and the counter 401 steps up one binary unit each time a PHS0 signal originating elsewhere is imposed at terminal C1k. In reality, this signal arrives every $1.6 \times 10^{-4}$ seconds and the Q binary address outputs progressively step up from binary 0 to binary 15 and start again at binary 0 in only $2.56 \times 10^{-3}$ seconds as do the connected address lines $AD2^0$, $AD2^1$, $AD2^2$, and $AD2^3$ which are also connected to address terminals A0, A1, A2 and A3, respectively, of a random access memory 402 with 16 address locations. As each binary memory address number reaches memory 402, the 4 bit BCD digit contents at that address appear on output terminals Q0, Q1, Q2 and Q3; this continued readout response is insured by a low signal ZERO at terminal $\overline{\text{CS}}$. The output coded data signals OCD0/ through OCD3/ are routed to input terminals I0 through I3 of a buffer latch 403 and that BCD digit is retained at output terminals Q0 through Q3 until the next PHS0 signal appears at terminal E2. Continuous operation of the buffer latch 403 is insured by a high signal ONE at terminal E1.

When a PHS2/ clock signal arrives at the write enable terminal $\overline{\text{WE}}$ of RAM 402 ($8.0 \times 10^{-5}$) seconds after the PHS0 signal which enabled the signal outputs, one BCD digit of write coded data, WCD0 through WCD3 previously discussed, is entered through terminals D0 through D3, respectively, into the memory 402 at the same address which was just read. As previously stated, write coded data is with three exceptions the same as the read coded data just read out. These exceptions SET the original primary memory contents, SUBtract the passage of moves, and seconds of time and ADD (to a recorded remainder of time) the time and moves preset in secondary switches and are discussed later.

Three of the address lines $AD2^0$, $AD2^1$ and $AD2^2$ are routed to preset/add sequencer 203 at the top of FIG. 4. Address lines $AD2^0$ and $AD2^2$ are routed directly to a preset/add demultiplexer 404 on input terminals A0 and A2, respectively; $AD2^1$ arrives at input terminal A1 via Or Gate 405. Input terminal A3 controlling binary numbers 8 through 15 is contacted by the SET signal only. When SET is a high signal the address signals $AD2^0$, $AD2^1$ and $AD2^2$ cause enable signals to appear at output terminals 8 through 15 in sequence and then 8 through 15 again if preset/add demultiplexer 203 is enabled at terminal $\overline{\text{E}}$, and the address binary numbers sequentially move from 0 through 15. When SET is a low signal the address signals $AD2^0$, $AD2^1$ and $AD2^2$ cause enable signals to appear at output terminals 0 through 7 in sequence and then 0 through 7 again while the address binary numbers continue up from 8 through 15 if enabled at terminal $\overline{\text{E}}$.

Preset/add demultiplexer 404 is enabled at $\overline{\text{E}}$ by a low true (scan enable) SCEN/ signal from Neg Nor Gate 407 except when a (seconds game) SECGM is true and high and signal SEC/ is untrue and high simultaneously. Neg Nand Gate 406 produces a true, low seconds signal SEC/ only when both $AD2^1$ and $AD2^2$ signals are low.

A high, true SECGM signal to Or Gate 405 forces a signal to input terminal A1 no matter what address signal $AD2^1$ is reading. Without other intervention output terminals would be energized in the following sequence: 2, 3, 2, 3, 6, 7, 6, 7. If at that point in the sequence the SET signal is on input A3 the output sequence will continue with 10, 11, 10, 11, 14, 15, 14, 15; however, a high SEC/ signal and a high SECGM signal operating through Neg Nor Gate 407 disable all except the first two digits in each string 2, 3, 10 and 11, thereby causing the lowest two digits of preset minutes (either primary or secondary) to be faked into both of the seconds display digits panels 36D and 36E or 37D and 37E.

Address lines $AD2^0$ through $AD2^3$ are also routed to display sequencer 204 where they contact input terminals A0 through A3 of display demultiplexer 412 which is active at all times by virtue of a low ZERO signal on enable/ terminal $\overline{\text{E}}$.

Address signals $AD2^0$ through $AD2^3$ contact N channel buffers 408 through 411 and provide low-drain pin connectors 33B0, 33B1, 33B2 and 33B3 for remote display connector 33.

Since demultiplexer 412 fully operates at all times the sequencing of binary address numbers 0 through 15 on address lines $AD2^0$ through $AD2^3$ causes enable signals to be sequentially presented on output terminals 0 through 15. The lowest five outputs LTM0 through LTM4 sequentially enable the lighting of 8-36E, 8-36D, 8-36C, 8-36B and 8-36A time digit panels for the left player and are carried by display enable lines 224. LTM0 and LTM1 pertain to the least and most significant seconds digits. The ENDL signal from terminal 5 signifies to various system elements that the scan of left times is complete. Terminals 6 and 7, MV0 and MV1 sequentially enable the least and most significant moves display digits 38B and 38A and are conducted thereto as a part of display enable lines 224. Terminals 8 through 12, RTM0 through RTM4 sequentially enable the lighting of 36E, 36D, 36C, 36B and 36A, the time digit panels for the right player. They are also a part of display enable lines 224. The ENDR signal from terminal 13 signifies to various system elements that the scan of moves and right times is complete and is coupled with the ENDL signal at Or Gate 413 to produce a high signal ENDSC signifying that no scan is in progress. ENDR is also used as an enable signal for yellow stop LED 34F. Signal IFL on terminal 14 enables green left LED 34B and IFR on terminal 15 enables green right LED 34D.

Address signal $AD2^3$ is brought out to signify to other system elements that display demultiplexer 412 is starting to scan the right times outputs. All outputs of demultiplexer 412 bear the names of corresponding addresses in memory 402. Signal LTM0 is inverted to LTM0/ by inverter 415 for use elsewhere in the system.

Figure 5:
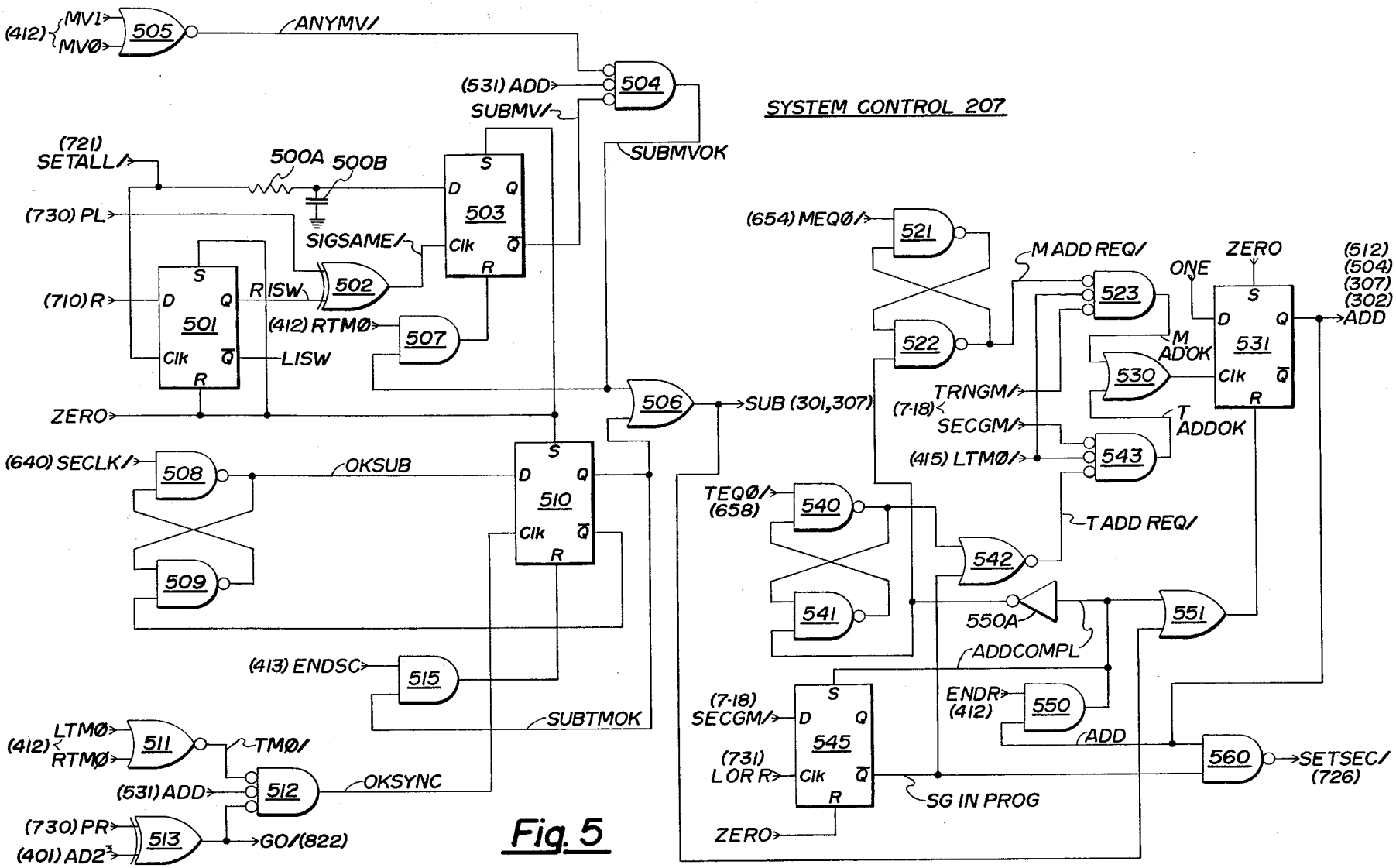
FIG. 5 is a detailed logic diagram of a part of the system control portion of FIG. 2.

With reference to FIG. 5, the left half of the logic hardware generates and stores the information on which player, left or right, is, in reality, white player with the white chess pieces, and also generates information on when to subtract or decrement: time left, time right, and moves panel displays; 37E, 36E and 38B, respectively. Looking at D-Flop 501, if right signal R is high on D input, when SETALL goes high on C1k input then Q output goes high creating signal RISW (right player is the white player), and since the C1k input will not change during the match, Q will stay where it was first set in a match. Player left, PL signal goes low in this first example. He is black player and inactive; his clock does not run down until white player finishes his move and presses his button 34C to transfer the active status. In this first example, a high RISW signal and a low PL signal are both conducted to exclusive Or Gate 502 and there is a high untrue signals same, SIGSAME/ output; the signals are not the same. However, the SETALL/ signal, which went high almost immediately after the high signal R appeared, is delayed for several gate reaction times by R.C. resistor 500A and capacitor 500B. The high output of Exclusive Or Gate 502 therefore arrives at C1k terminal of D-Flop 503 while SETALL/ at terminal D is still low and output Q which was set low by signal ZERO stays low; $\overline{Q}$ stays high so no true, low subtract move/ signal SUBMV/ is generated. When white (R in this first example) finishes his move and presses his switch 34C, player left signal PL, goes high; black in this example has now become the active player. A high PL signal and a high RISW signal at Gate 502 cause a true, low SIGSAME/ output so no high pulse reaches C1k terminal of D-Flop 503 and the $\overline{Q}$ status stays the same although signal SETALL/ input at terminal D has been high a long time. However, on the next change of active player back to white when black (L in this first example) presses his switch 34A at the end of his move PL again goes low. PL signal low and RISW signal high causes a high output SIGSAME/ from Exclusive Or Gate 502 which is conducted to C1k terminal of D-Flop 503 and with a SETALL/ high signal at terminal D; output Q goes high, output Q goes low and a ture, low subtract move SUBMV/ signal is conducted to Neg And Gate 504 to subtract a move at the end of black's (in this case left) play.

If, on the other hand, right, instead of left, is the black player, he hits his switch 34C to begin the match. R at terminal D of D-Flop 501 goes low and almost immediately a high signal arrives on SETALL/ at C1k terminal and clocks output Q (RISW) low and untrue to match the D input. $\overline{Q}$ therefore goes high signifying that left is white (LISW); PL comes in high to Exclusive Or Gate 502, together with RISW low to create a high false SIGSAME output which arrives at C1k terminal of D-Flop 503 too early to catch the low-to-high change in SETALL/ which is slowed down enroute to terminal D of D-Flop 503 as previously explained. As before, and for similar logic reasons, no high, untrue, signal emerges as subtract move, SUBMV/ from Gate 502 until black (in this second example right) ends his move and hits his switch 34C. Moves decrement or subtract only when the black player completes his play and hits his switch.

A low true SUBMV/ signal at $\overline{Q}$ (503) enables one input terminal of Neg And Gate 504. The presence of either move signal MV0 or MV1 at Nor Gate 505 creates a low signal, ANYMV/ which enables a second input terminal of 504. If ADD is untrue and low at the third terminal, a high SUBMVOK signal (based on player and move information) is conducted to Or Gate 506. That same signal arrives at And Gate 507 and when the display sequencer 204 reaches RTM0, an output signal is conducted to reset terminal R of 503, shifting $\overline{Q}$ to 1, and thereby terminating the low SUBMV/ signal.

When a SECLK/ signal drops low once every second, it changes the state of a bi-stable latch composed of Nand Gates 508 and 509 sending a true, high signal (OK to subtract) OKSUB, to data terminal D of D-Flop 510 which will be transferred to output terminal Q when the C1k terminal goes high.

When either LTM0 or RTM0 are present at Nor Gate 511 a low signal indicating that time equals 0, TM0/ is present at the output and enables one terminal of Neg And Gate 512. Exclusive Or Gate 513 insures that, whomever (L or R) is the active player, nothing will be changed until the sequencing of memory addresses indicates that display sequencer 204 is in the proper half of its sequencing action (left=lower half and right=upper half). Only when signals PR, player right, and $AD2^3$, upper half, match either as 1's or 0's will a low GO/ signal be produced to enable a second terminal of Neg And Gate 512. If simultaneously the ADD signal is low, an OKSYNC high signal is conducted to the C1k terminal of D-Flop 510 and, with terminal D high from signal OKSUB, output Q goes high producing a subtract time, SUBTMOK signal which is conducted to Or Gate 506 where SUBTMOK or SUBMVOK signals = SUB, subtract. The SUBTMOK signal is also conducted to And Gate 515 and when the rising sequence of display sequencer 412 reaches either ENDL or ENDR (combined at 413 at ENDSC), a high signal is conducted to reset terminal R of D-Flop 510; Q goes low, stopping signal SUBTMOK and Q goes high, when Q originally went high, $\overline{Q}$ went low and, at Nand Gate 509, causes a change of state of the bi-stable latching pair and removes the OKSUB signal from the D input of D-Flop 503.

On the right side, if moves equal 0 signal, MEQ0/ at Nand Gate 521 goes high, it changes the state of the bi-stable latch pair which includes Nand Gate 522 causing a moves addition required, MADDREQ/ low signal to enable one terminal of Neg And Gate 523. Moves equal 0 normally only at one point in a tournament game (TRNGM/) when the preset primary or the increment of preset secondary moves have been counted down to 0. At that moment a new increment of moves is needed for the match to continue and an additional preset increment of time must be added with them. When TRNGM/ signal is true and low, a second terminal of Neg And 523 is enabled. As soon as the display sequencer 412 arrives at output 0 (where all scans or sequences start), a special LTM0 low signal enables the third terminal of Neg And Gate 523 and a moves add OK, MADOK, high signal is conducted to and through Or Gate 530 to the Clk terminal of D-Flop 531 where (with a high, ONE signal on terminal D), it causes output Q to go high and creates the add command signal ADD.

In the tournament game, TRNGM/, moves decrement to 0 and require addition of new increments of moves and time. In the fast game, no addition is required. In the seconds game, SECGM/, where preset minutes of time at switches 21 and 24 are actually added in on the seconds panels 36E, 36D or 37E and 37D, of the time displays, and where time is read as time-per-move instead of time per match, there is provision for an overrun or *grace* period when the primary time-per-move decrements to 0, TEQ0. That high signal at Nand Gate 540 changes the state of the bi-stable latch pair which includes Nand Gate 541, causing a low signal to be conducted to Nor Gate 542.

If a seconds game (SECGM/) has been planned, a low signal is at data input D of D-Flop 545. If it is actually being played, LORR, a high signal is at Clk terminal and Q output will be low with $\overline{Q}$ output high creating a signal confirming that seconds game is in progress, SGINPROG. This high signal is conducted to Nor Gate 542 and with the low signal from TEQ0/- causes a low signal indicating a time addition is required, TADDREQ/, to enable one terminal of Neg And Gate 543. The actuality of a seconds game, SECGM/ enables a second terminal and as soon as the display sequencer 412 arrives at output 0 where all scans or sequences start, a LTM0/low signal enables the third terminal of Neg And Gate 543 and a time addition OK, TADDOK, high signal moves to and through Or Gate 530 to Clk terminal of D-Flop 531, creating an add command signal, ADD at output Q.

The ADD signal which started at the beginning of a signal scan or sequence (LTM0) is routed to And Gate 550 and as soon as a full scan of all times and moves is complete, signal ENDR goes true and high and an addition completed high signal ADDCOMPL, is conducted to and through Or Gate 551 and to reset R terminal of D-Flop 531 which forces output Q to 0 and terminates the add command signal ADD. In like manner, a SUB signal from Or Gate 506 passing through Or Gate 551 will terminate ADD. The ADD signal is also routed to Nand Gate 560 where, with the SGINPROG signal it causes a low signal to set seconds in lieu of minutes, SETSEC/, a previously discussed characteristic of the seconds game. The addition completed high signal ADDCOMPL from And Gate 550 is routed to D-Flop 545 and also through inverter 550A to the bi-stable latch gate pairs for MEQ0/ and TEQ0/ to again initialize their output states.

Figure 6:
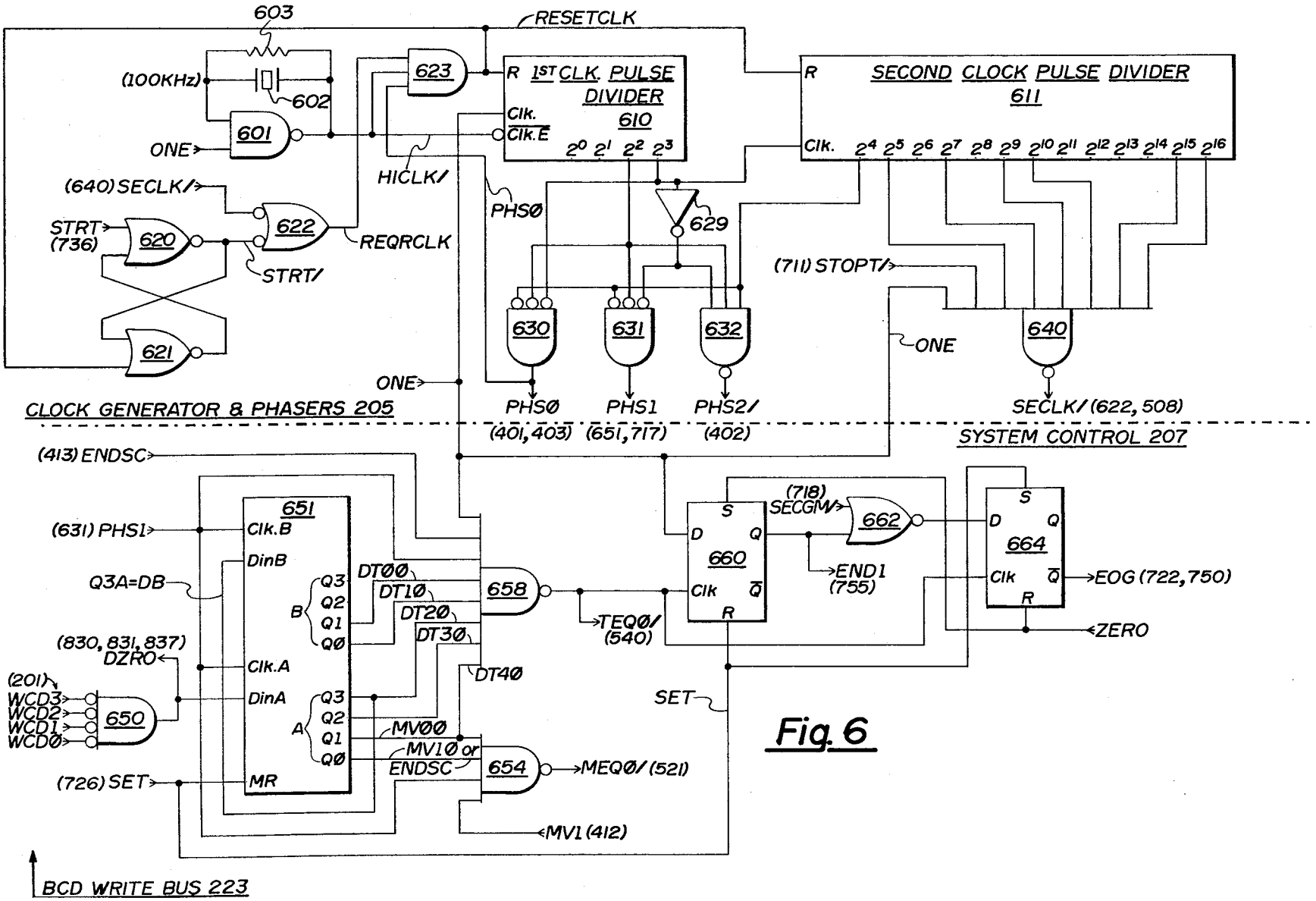
FIG. 6 is a detailed logic circuit diagram of the clock generator and another part of the system control portion of the functional block diagram of FIG. 2.

Diagrammed in the upper portion of FIG. 6, is the clock generator and phasers 205 which, by the connection of a high signal ONE at Nand Gate 601 starts running the instant that power switch 7-17A is turned on. ONE, initially the only high signal on Nand Gate 601, creates a high output which passes through crystal 602 and resistor 603 to enable another terminal of Nand Gate 601 which immediately drops the output low. This self-generated oscillation continues at the natural frequency of crystal 602 and appears as a highest frequency clock signal, HICLK/ until the system is turned off and ONE drop to 0. The HICLK/ signal pulse train is connected at the $\overline{\text{ClkE}}$ terminal of the first clock pulse divider 610 where an additional high signal, ONE, on the Clk terminal assures continued operation. Outputs $2^0$(HICLK/), $2^1$(HICLK/ ÷ 2), $2^2$(HICLK/ ÷ 4) and $2^3$(HICLK/ ÷ 8) are available for creating pulse trains slower than 100KHZ. The $2^3$ output is routed to the Clk terminal of the second clock pulse divider 611 where further divisions of train frequency occur with outputs $2^4$(HICLK/ ÷ 16), $2^5$(HICLK/ ÷ 32), etc., and finally culminating in the slowest pulse train output $2^{16}$ (HICLK/ ÷ 65,536).

The HICLK/ pulse train and dividers are always in operation, but to secure meaningful time spans from them, it is necessary to reset both dividers 610 and 611 to 0. This is accomplished in two ways. First, when either player presses his switch (7-34A or 7-34C) or, after a game has been momentarily stopped, when a judge presses the continue switch 7-27, a start command signal, STRT is routed to Nor Gate 620 which changes the state of a bi-stable latch pair which includes Nor Gate 621, causing a low STRT/ signal to reach Neg Or Gate 622 which in turn will pass on a high signal for require reset, REQRCLK. Neg Or Gate 622 can be secondly triggered by a momentarily low seconds clock, SECLK/ signal indicating that a second of time has passed and the dividers must be reset to 0 to accumulate the next second. In either case, the REQRCLK high signal enables one terminal of And Gate 623; when a high signal clock phase 0, PHS0 occurs, a second terminal is enabled and when the next HICLK/ pulse code goes high, the third terminal is enabled. A high signal RESETCLK is conducted to clock dividers 610 and 611 and also to Nor Gate 621 of the bi-stable latch pair which includes Nor Gate 620, changing the state of that pair and removing STRT/ signal from Neg Or Gate 622.

Pulses begin to accumulate and interconnections to divider outputs $2^2$, $2^3$ and $2^4$, together with inverter 629 cause: Neg And Gate 630 to produce a high momentary PHS0 clock pulse approximately $1.6 \times 10^{-4}$ seconds after RESETCLK pulse. Approximately $4 \times 10^{-5}$ seconds later Neg And Gate 631 produces a high momentary PHS1 clock pulse and approximately $4 \times 10^{-5}$ seconds after that Nand Gate 632 produces a low momentary PHS2/ clock pulse followed in approximately $8 \times 10^{-5}$ seconds by PHS0 and a repeat of the cycle. These pulses are used to clock high speed computing elements within chess clock 11 and to drive address sequencer counter 401 which governs all scanning and sequencing within the system.

Slower pulses from clock divider 611 outputs are interconnected with an eight-input Nand Gate 640 to divide the HICLK/ frequency by 100k or whatever the exact frequency of cristal 602 happens to be. This produces one momentarily low signal SECLK/ every second if the power is on, (ONE), and the play has not stopped, STOPT/.

A portion of system control 207 appears at the bottom of FIG. 6 and concerns generation of the TEQ0/ and MEQ0/ signals required to develop the ADD command on FIG. 5. Parallel 4 bit BCD write outputs from arithmetic unit 201 are continually sequentially presented at Quad Input Neg And Gate 650 (at clock PHS0 time). Whenever all four bits WCD0, WCD1, WCD2 and WCD3 are 0, the Gate 650 outputs a momentary high signal that that particular digit is 0, DZERO, which is connected to the data input terminal DinA of a dual 4 bit shift register 651. The signal at DinA and at output AQ0 is transferred on the following clock pulse to the next higher output AQ1, AQ2, AQ3. By virtue of the signal interconnect line Q3A=DB, and the fact that signal PHS1 drives both ClkA and ClkB synchronously, the register 651 behaves like an 8 bit shift register and AQ3 data moves on to BQ0, BQ1, BQ2 and BQ3, after which point it disappears.

Whenever both moves digits from BCD write bus 223 are 0, as determined by the DZERO output of Neg And Gate 650, and when their zero digit equivalents, MV00 and MV10 have been shifted up to outputs AQ1 and AQ0, respectively, they jointly enable two input terminals of Quad Input Nand Gate 654. To insure that this 2 output window (AQ1 and AQ0) contains only move data, a third data input terminal of Gate 654 is enabled by a high signal MV1 from display sequencer 412 and by a fourth clock pulse PHS1 which is also high. Nand Gate 654 will output a true low moves equal zero, MEQ0 signal only when both zero digit equivalents are in the 2 output window.

Time equals zero, TEQ0/ is a true low signal output from Eight Input Nand Gate 658. It occurs only when a five-output window AQ1 through BQ1 of register 651 is occupied by the five-time zero digit equivalents DT00 through DT40. An additional high ENDSC signal from gate 413, a high PHS1 clock signal, and a high ONE signal enable the other terminals of Nand Gate 658 and insure that the five output window contains nothing but time data.

Early in the game, before play starts, a high SET signal at terminal MR initializes register 651 at the zero position and, on terminal R of D-Flop 660 forced a low signal at output Q, end of primary time, END1, even though input signal ONE at D was high. The same high SET signal on terminals S of D-Flop 664 force a low signal at output $\overline{Q}$, representing end of game, EOG, even though input signal on terminal D was low (for any other game except the seconds game, SECGM/), END1 low and SECGM/ high (no seconds game being played), at Nor Gate 622 result in a low output to D of D-Flop 644. Until this instant there has been no clock pulse to disturb those settings.

When a momentarily low TEQ0/ signal ceases, a rising or high signal takes its place at Clk inputs of both D-Flops 644 and 660. At 644 the existing low input at D is immediately clocked across to Q, $\overline{Q}$ therefore goes high and a true end of game, EOG signal is created for the tournament and fast games because time has run out. At 660 the high signal ONE input to D is clocked across to Q which causes END1 to go high but this effect does not reach terminal D of D-Flop 664 in time to change its action.

If a seconds game, SECGM/ is being played that low signal enables one terminal of Nor Gate 622 and, with the originally false low END1 signal on the second terminal, a high output is routed to terminal D of D-Flop 664. In a seconds game this high input is clocked over by TEQ0/ rising at output Q but there is no change in status from that which was originally established by SET. END1 did go high as before, causing a short buzz on buzz speaker 7-26A, but this effect did not reach terminal D of D-Flop 664 in time to change its action.

After the first TEQ0/ pulse in the seconds game, the SECGM/ is still low and true but END1 has now changed to high and true so the output of Nor Gate 622 is now low. The primary seconds per move have been used up and the active player is in his secondary grace period (see FIG. 9 for game format descriptions). If that player does not make a move before TEQ0/ occurs a second time, he loses, and the rising pulse following the momentarily low TEQ0/ will enter Clk terminal of D-Flop 644 and clock across the *now low* signal on terminal D to output Q causing $\overline{Q}$ to go high and the EOG signal announces the loss and the end of the seconds game.

The momentary player switches 206 are seen at the upper left of FIG. 7. They are the right player switch 34C, the left player switch 34A, and the stop switch 34E. All are shown in an open position with switch levers connected to ground. Two output lines from each switch enter system control 207.

Judge switches 210 are seen at the center left and include blanking switch 7-28 which in the upper position shown receives selective blanking instructions BSEL/ and when in the down position is grounded to fully blank out all displays. By means of game type switch 7-18, a tournament game (upper position) can be selected with a low signal TRNGM/ output on the upper line, a fast game (middle position, no output required), and a seconds game (lower position), with a low signal SECGM/ output on the bottom line. There is a momentary continue switch 7-27 by which a judge can restart a game (stopped by players stop switch 34E) by producing a high signal CONT. By means of a select L or R switch 7-22 a high SELR signal is produced for right and a low signal SELR/ for left. This signal determines which player will receive the preset time input from primary time switches 3-21. Reset switch 7-17B when momentarily raised to the upper reset position, allows a high signal to be routed to system control 207. Power switch 7-17A turns on power circuits 209 when placed in the middle of the momentary upper position.

Power circuits 209 comprise a power connector 7-32 with a high lead PWR1 and a low, ground lead PWR2, to which the minus side of internal battery 7-29 is connected, and from which a zero or low signal line proceeds to other system units. A protective diode 701 is located between the plus side of battery 7-29 and the high lead PWR1. The plus side is also connected to power switch 7-17A. When power switch 7-17A is closed, a high signal ONE proceeds to other system units, VCC power is supplied to system units, a momentary high initializes INIT signal is created through inverter 702 cooperating with resistor 702A and capacitor 702B to initialize various system units, and power is delivered through dropping resistors 703A and 703B to voltage sensor 703 which turns on red low LED 7-31 when battery voltage drops significantly low. A charger power pack (not shown) may be plugged into power connector 7-32 to recharge battery 7-29 or to power the entire unit; however, the unit because of its low drain characteristics, may be run on battery power alone.

A section of system control 207 which responds to a majority of player switches 206 and judge switches 210 is shown in the upper portion of FIG. 7. A multiple latching Quad Flip-Flop 710 is provided to debounce switches connected to input terminals; S0 receives the *open* line and R0 the *closed* line from right player's switch 34C; S1 receives the *open* line and R1 the *closed* line from left player's switch 34A, S2 receives the *open* line and R2 the *closed* line from reset switch 7-17B, and S3 receives the *open* line while R3 receives the *closed* line from stop switch 34E.

When inputs S3 goes high because the grounded stop switch lever 34E is lowered, output Q3 conducts a high stop signal, STOP, to data input terminal D of D-Flop 711 and to one terminal of Or Gate 712 which outputs a high signal to one terminal of And Gate 716. When a high signal PHS1 and a high signal END1 are at the terminals of And Gate 717 simultaneously, a high signal indicating that stop or start are OK, STOPSTRTOK, is conducted to a second terminal of And Gate 716 creating a high signal output to Clk terminal of D-Flop 711, causing output $\overline{Q}$ to go low and to output a true low stopped signal, STOPT/ and Q to go high and create a second stopped signal, STOPT (unless terminal R is high) which is routed to N channel buffer 718 to provide a low drain pin connection 33Cl for remote display connector 33. The high STOPT signal is also routed to one terminal of And Gate 719 and when ENDR signal occurs and is input on the second terminal a high output signal stop driver, STDR, is produced and routed to a multiple, biased-Darlington display driver 720 at upper left, which powers and lights yellow stop LED 34F.

When reset input S2 of Flip-Flop 710 goes high, a high signal RESET is output at terminal Q2 and routed to terminal D of D-Flop 721 and also to and through Or Gate 712 to one terminal of And Gate 716. If a high STOPSTRTOK signal from And Gate 717 is also present at a second terminal, And Gate 716 outputs a high signal to Clk terminal of D-Flop 721 and $\overline{Q}$ outputs a low SETALL/ signal while Q outputs a high signal to one terminal of Or Gate 722 (unless terminal R is high) and through it to the S terminal of D-Flop 711 where Q is forced high and a high game stopped, STOPT signal is output. The end of game signal EOG, on the second terminal of Or Gate 722 will have the same effect.

The low SETALL/ signal, output of terminal $\overline{Q}$ of D-Flop 721, enables one terminal of Neg Nand Gate 725. When a low signal SYNCOK/ also enables the second terminal of Neg Nand Gate 725, a low signal passes to one terminal of Neg Or Gate 726 and, on the way through, the signal is inverted to emerge as a high set command SET signal. A low signal SETSEC/ on the second terminal of Neg Or Gate 726 will also cause a high SET command signal.

The SYNCOK/ low signal (required to complement SETALL/ at Neg Nand Gate 725) originates as the output of exclusive Or Gate 724 and only occurs when both inputs are simultaneously high (as indicated at select switch 7-22) or when both are simultaneously low. If, as indicated, player right (with a high signal SELR) has been selected to receive the present time inputs, his half of display demultiplexer 412 extends from output 8 through output 12 which is characterized by address line $AD2^3$ being also high. Player left's position at select switch 7-22 with a low signal SELR/ is in the lower half of demultiplexer 412 from output 0 through output 4 and is characterized by address line $AD2^3$ also being low. Therefore, the Exclusive Or Gate 724 insures that a specific player is synchronized with his specific location in memory 402.

Since output terminal Q of D-Flop 721 is driven high at the beginning of clock action by signal INIT from power circuits 209 at the S terminal, the game is effectively STOPT through Or Gate 722 and the S terminal of D-Flop 711 which drives that Q output high. Simultaneously, SETALL/ is a continuous low signal before the match begins, being driven low by INIT at the S terminal of D-Flop 721.

When the left player input S1 of Flip-Flop 710 goes high, Q1 also goes high and conducts a right signal R to data input D of D-Flop 730. The left player switch 34A, being momentarily turned on, created a right signal R because when a player's switch is hit, his opponent's time starts to run down; his opponent becomes the active player. If the left player hit his switch first to start the match, then he must be black. White is given the first opportunity to move in all chess games.

Right signal R is also routed to one terminal of Or Gate 731 wherein it emerges as a high output signal (left or right) LORR, which enables one terminal of And Gate 732. If a high STOPSTRTOK signal enables the other terminal a high output will be routed to Clk terminal of D-Flop 730 which (with a high R signal at D) will cause Q to ouput a high signal indicating that player right PR, is locked in the active category until he hits his switch 34C. Signal PR is also routed to N channel buffer 733 to provide a low-drain pin connection 33C2 for remote display connector 33.

PR is also conducted to enable one terminal of And Gate 734. When a IFR high signal enables the second terminal of And Gate 734, a high output signal right driver RDR is produced, and routed to the display driver 720 which powers and lights green right LED 34D. The action of D-Flop 730 also causes $\overline{Q}$ to go low.

The high output of And Gate 732 is also conducted to one terminal of and through Or Gate 736 and is output as a high level start signal, STRT which is routed to the R terminals of both D-Flops 711 and 721, and removes both the STOPT/ and the SETALL/ signals by driving both $\overline{Q}$ outputs high. STRT may also originate when a high continue signal, CONT is output at continue switch 7-27 and conducted to a second terminal of Or Gate 736. The high R signal which initiated the chain of events just discussed goes low as soon as left player switch 34A is released.

When right player switch 34C is momentarily depressed the S0 terminal of Flip-Flop 710 goes high and Q0 outputs a momentarily high L signal which is routed to one terminal of Or Gate 732 and creates a high signal LORR which proceeds through And Gate 732 as explained above and enables Clk terminal of D-Flop 730, as before. However, by now the R signal at the D terminal of 730 has gone low and the high input at the Clk terminal transfers that low D signal across to output Q and also causes $\overline{Q}$ to go high, producing a high or true player left PL signal, which is routed to enable one terminal of And Gate 738, and indicates that player left is now locked into the active category. When an IFL high signal is at a second terminal of And Gate 738 a high left driver, LDR signal is produced and routed to display driver 720 which powers and lights green left LED 34B. The high signal from And Gate 732 which enables Clk terminal of D-Flop 730 is also routed to Or Gate 736, creating a high start signal, STRT and reversing as mentioned before both the STOPT/ and the SETALL/ signals from D-Flops 711 and 721.

Buzz circuit 208 is detailed at the lower right of FIG. 7. A high end of game, EOG signal is routed to a capacitor 750 which is voltage-biased by resistor 750A and bleeds to ground through resistor 750B creating a long tone network 750 which maintains a low output, end of game dwell, EOGD, for only approximately 1¼ seconds and is routed to one terminal of Neg Nand Gate 760. A high end of primary game, END1 signal is routed to capacitor 755 which is voltage-biased by resistor 755A and bleeds to ground through resistor 755B creating a short tone network which maintains a low output signal END1D, for only approximately ½ second, and is routed to a second terminal of Neg Nand Gate 760. Either signal produces a high signal out of Or Gate 760 which disables the reset R terminal of oscillator 762, thereby starting oscillation and continuing it until the input to the R terminal again goes low. Frequency of oscillator 762 is established by resistors 763 and 764 and by capacitor 765 at approximately 1,000 HZ. The oscillator tone output at terminal Q may be interrupted by buzz switch 7-26B if players object to the tone warning. When closed, the tone output passes through capacitor 770 which acts as a fail-safe-off device in case oscillator 762 fails high. The tone output continues to resistor 775 which presets the volume of sound at buzz speaker 7-26A.

Display decoder 212 is detailed at the upper left of FIG. 8 where BCD write bus 223 inputs WCD0, WCD1, WCD2 and WCD3 are routed to data inputs D0, D1, D2 and D3, respectively, of BCD-to-seven segment decoder 801. A high ONE signal is routed to the light test terminal $\overline{LT}$ because that terminal is not used in the system. Blanking information in low signal BLNK/ is routed to terminal $\overline{BI}$, from blanking switch 7-28 where the choice is made between blanking all digit panels or blanking only selected digit panels. Seven leads from terminals (*a*) through (*g*) of decoder 801 comprise seven coded lines (228) each of which enables the same segment of all ten digit panels in time and move displays 213. These are powered by individual power lines from display drivers 810 and 811, each of which contain six biased-Darlingtons which receive display enable lines 224 from display demultiplexer 412. Lines RTM0 and RTM1 enable power for the lowest and highest seconds digits of the right displays 37E and 37D. Lines RTM2, RTM3 and RTM4 enable power for the lowest through the highest minutes digits 37C, 37B and 37A. Lines LTM0 and LTM1 enable power for the lowest and the highest seconds digits of the left display 36E and 36D. Lines LTM2, LTM3 and LTM4 enable power for the lowest through the highest minutes digits 36C, 36B and 36A. Lines MV0 and MV1 enable power for the lowest and highest moves digits 38B and 38A.

A section of system control 207 used to selectively blank out unneeded digit panels in time and move displays 213 is shown at the lower right of FIG. 8. Or Gate 820 has a high output only when one or both moves are being scanned and the output of And Gate 821 is high when one or both moves are being scanned *and* the system is *not* in tournament game status. Therefore, move displays 8-38 are blanked out except for the tournament game. If the system is in the seconds game (And Gate 823) all minutes digits are blanked (Sec/ at Nor Gate 822) and seconds digits are also blanked (GO/ at Nor Gate 822) unless the active player and his memory position coincide; (see Excl. Or Gate 513). When the most significant digits or the two most significant minutes digits are 0 or the most significant moves digit is 0 or seconds digit is 0 (at inverter 828) then through 4 input Nand Gate 835, blanking is signaled to Neg Or Gate 836 and And Gate 837. D-Flops 830 and 831 store the 0 status of most significant time left and/or right, respectively, and when the next significant time digit left and/or right becomes 0 at Nand Gates 833 and 834, respectively, its blanking is also signaled through Neg Or Gate 836, And Gate 837 and Nor Gate 840 which collects all three major blanking categories and outputs a single low blank selectively signal BSEL/ which is routed to blanking switch 7-28.

Having discussed the generation and significance of all system information logic signals, a discussion of actions within arithmetic unit 201, FIG. 3, is now possible. In less than 1/100 second after clock 11 is turned on, all systems components are initialized and stable. The seconds clock 640 is disabled by a low signal STOPT/ but the SET command is high and active. SET is initially active in this manner because D-Flop 721 is initialized low at $\overline{Q}$, SELR at Exclusive Or Gate 724 is also shown at being high so a true, low SYNCOK/ signal can only be generated when address line $AD2^3$ is also high signifying that SET can be high only during the scan of addresses 8 through 15 in memory 402. Since memory contents at 8 through 15 are lost at blocking gates 330 through 333, any leftover memory contents are first lost and then replaced by SET data from preset switches 3-21 and 3-19.

Sequencing in display demultiplexer 412 is continually scanning upward, 0 through 15 over and over again; however, effective sequencing in preset/add multiplexer 404 is controlled in a different manner if the effect of SET control input for player right is considered. The actual sequencing is scanning addresses upward 0 through 15 but SET is not high until the scan reaches output 8; at that point SET goes high at input A3 of demultiplexer 404 and fakes an $AD2^3$ input at the same time $AD2^3$ goes high. Enable signals go out on EST0 through ESM1 but cannot cross through switch multiplexer 301 until SET goes high when $AD2^3$ goes high. Therefore, only primary time and moves are accepted from switch bus 221 on BCD lines SW0 through SW3 at (301) input terminals Y0 and Y3 and transferred to outputs Q0 through Q3 which are conducted to inputs B0 through B3 of BCD adder 303. Since all read lines RCD0 through RCD3 at 303 inputs A0 through A3 are made low by SET at blocking gates 330 through 333, the primary time and moves data called for by enable lines EPT0 through EPM1 pass unchanged through the BCD adder (no seconds) and appear on BCD write coded data lines WCD0 through WCD3, which are directly read in parallel into the upper memory 402 addresses in the proper sequence shown by display demultiplexer 412. Addresses 14 and 15 receive BCD numbers from move switches 3-19B and 3-19A, respectively, but this is throw-away data and is never used.

The right SET sequence described above immediately causes right minutes displays 8-37A through 8-38C to show the contents of primary time switches 3-21A through 3-21C, followed by 0 and 0 on right seconds displays 8-37D and 8-37E. If right's minutes are not as agreed to prior to the game, primary time switches 3-21A through 3-21C can be changed until the agreed upon time is displayed.

Moves and left times may appear as garbage numbers left over from previous games or random memory contents, but these are both corrected by the following sequence.

If the select R or L switch 7-22 is toggled from the R to the L position, the system is in a set left condition; right primary time is in memory and frozen in the numerical status shown on right displays 8-37. After the toggle, left displays 8-36 show exactly the same time as right displays, 8-37. Moves displays 8-38 show the numerical values set into primary moves switches 3-19. A greater or lesser time allowance may be set in for left player without changing that for right player. However, if primary moves 3-19 are changed, that change applies equally to both players. Here, again, as the switch inputs change, the left and move displays immediately change.

Either player left or player right may be set first. The first to be set is frozen when the second is being set but the second settings are not frozen until the black player hits his switch to start the match. Whichever is set first, the moves inputs are set only with the left player.

Left set operation begins with select R or L switch 7-22 being moved to L which causes SELR signal to be untrue and low. During the lower half of memory scan, when signal $AD2^3$ from address sequence counter 401 is also low, a low true output SYNCOK/ from Exclusive Or Gate 724 allows SET to again be high and true. Here exists another unique faked signal situation. SET exists only when $AD2^3$ is not true and simultaneously SET fakes an $AD2^3$ signal. Essentially, this means that SET enables outputs from only the upper half of preset/add demultiplexer 404 while scanning up through the memory locations in only the lower half of display demultiplexer 412. Thus, the inputs of primary time 3-21 enable signals at locations 10 through 12 of 404 are entered into 402 memory locations 2 through 4 as shown at display demultiplexer 412 and the primary moves 3-19 enabled at locations 14 and 15 of add demultiplexer 404 are entered in 402 memory locations 6 and 7 as shown by display demultiplexer 412.

Unlike before, the faked correspondence of enable signals 220 from the high half of demultiplexer 404 with memory locations indicated by the low half of demultiplexer 412 allows preset switch signals to be entered in the memory 402 at meaningful time locations for the left player and meaningful moves locations that apply to both players.

After primary time and moves have been entered in memory 402 for both players and black player has started the match, SET signal goes low and the seconds clock 640 is enabled. The preset/add demultiplexer 404, which until this moment was only scanning the upper half of switch enable signals from 8 through 15 is now totally without a high signal at input A3 (SET is completed and low) and it now scans only the lower half from 0 through 7. This short scan occurs twice while display demultiplexer 412, which is not deprived of $AD2^3$ signal, completes a long scan from 0 through 15.

As white player contemplates his first move, a momentary true, low signal SECLK/ indicates that a second has passed and, through the subtract network at the left of FIG. 5, a SUB signal emerges at the instant that white player's least significant seconds digit is being scanned at address 0 or 8 (for left or right, whomever is white). The SUB signal at input A enables input terminals X0 through X3 of switch multiplexer 301 which always receive a hard wired BCD=9 signal combination. That BCD=9 is not transferred to outputs Q0 through Q3 and conducted to inputs B0 through B3 of BCD adder 303, where it is added to the lowest seconds BCD value (in this case 0 seconds) of white. Read lines 222 being no longer blocked by the SET signal are inverted by the blocking gates 330 through 333 and presented at input terminals A0 through A3 of BCD adder 303. BCD=9 is added to every digit in white's time sequence from TM0 through TM4; the answers appear at outputs Q0 through Q3 and the SUB signal goes low at the end of that scan, ENDSC (see Gate 511). The *carry l* output from the most significant digit's addition is, however, thrown away by signal CNEG from Neg And Gate 307 so the net effect is the subtraction of one least significant digit, i.e., 120.00 + 999.99 = (1)119.99 with the (1) being lost.

Subtraction (SUB) is effected by the addition of nines and then neglecting the most significant digit. But the answer is wrong; 120 minutes minus 1 second is not 119 minutes and 99 seconds so the seconds digit must pass through modulo 60 Gates 309, 310 and 311 where the most significant seconds 9 is modified and faked to be a 5. The correct answer, e.g., 119 minutes, 59 seconds, appears sequentially on BCD write bus 223 to update white's display and memory contents. The faking action occurs only when the highest seconds digit is over 5; at all other times the modulo 60 gates are transparent and signals pass through without change.

Each time a second elapses, SUB goes high and decrements the time display of the active player. In a similar manner, after the game has started, move count is decremented every time black hits his switch.

An ADD signal goes high normally once in a tournament game; never in a fast game, and very frequently in a seconds game (see FIG. 9 at secondary time). In a tournament game whenever primary moves are decremented to 00 the ADD signal goes high. The BCD memory address contents are programmed out in parallel and sequentially from addresses 0 through 15 on read lines 222 to reach input terminals A0 through A3 of BCD adder 303. At the same synchronous scan rate, enable signals are output from only the lower half of preset/add demultiplexer 404; outputs 0 through 7 corresponding with locations 0 through 7 at display demultiplexer 412 and then again outputs 0 through 7 from demultiplexer 404 repeat to correspond on the second scan with locations 8 through 15 at demultiplexer 412.

The enable signals, EST0, EST1, EST2 - ESM0, ESM1 and a high ADD signal sequentially bring to switch multiplexer 301 and through it to terminals B0, B1, B2 and B3 of BCD adder 303 the BCD contents of secondary time switches 3-24C, 3-24B and 3-24A followed by the BCD contents of secondary moves switches 3-23B and 3-23A as seen in parallel sequence on lines SWO/, SW1, SW2 and SW3 comprising BCD switch bus 221.

As these appropriate secondary switch signals appear in parallel synchronously with BCD read lines 222 they are added together and output at terminals Q0 through Q3 of BCD adder 303 directly to BCD write bus 223 to update contents of memory 402 and time and moves displays 213. Since no seconds were added, the modulo 60 Gates are transparent. Moves change from 00 to the new secondary number. To what was left of right player's primary time was added the secondary increment and the same amount was added to left player's time. The tournament game continues until some player wins or some player's time decrements to 0 or, in an unusual case, play continues and when moves again decrement to 00, ADD again goes high and secondary time and moves are again added in.

In a seconds game where times are allocated on a per move instead of a per game basis, and where the two lowest minutes or preset switch inputs are internally faked for display as seconds, the SET signal goes high and primary time switches 21B and 21C are set-in as seconds at the active player's time display each time his move time starts. When that move time decrements to 00, before the active player completes his move and hits his switch, the ADD signal goes high and the contents of secondary time switches 24B and 24C are added in as seconds of grace period within which he must complete his move and hit his switch or lose the game.

The functions of SET, which initially enters time and moves allowances agreeable to both players, SUB, which decrements the time and moves allowances as seconds pass and moves are used up, and ADD, which effects the entry of additional secondary time and moves allowances, have all three been fully explained in detail.

The charted contents of FIG. 9 are self-explanatory. There are three programmable game types within which primary and secondary time and move parameters are also programmable and further primary game time may be programmed differently for each player, except in the seconds game.

The invention claimed is:

1. A chess clock comprising:

first and second digital readout means;

a digital memory means coupled to said first and second digital readout means, said memory means operable for receiving at least one predetermined programmed time period, said first and second digital readout means operable for counting down from a predetermined programmed time period total in said memory means;

switch means coupled to said memory means and operable for starting a counting down of one digital readout means and stopping a countdown of the other of said first and second digital readout means; and an add time means coupled to said memory means for adding any unused time from one period into a subsequent programmed period of time.

2. A chess clock comprising:

first and second digital readout means;

a digital memory means coupled to said first and second digital readout means, said memory means operable for receiving at least one predetermined programmed time period, said first and second digital readout means operable for counting down from a predetermined programmed time period total in said memory means switch means coupled to said memory means and operable for starting a counting down of one digital readout means and stopping a countdown of the other of said first and second digital readout means; and game select means coupled to said memory means by which at least three game formats may be presented for player timing control, each of such game formats being uniquely indicated by the blanking of certain digits on said first and second digital readout means.

3. A chess clock comprising:

a clock for generating a series of periodic pulses;

an address sequence counter connected to said clock generator for producing a sequence of digital coded number addresses;

a digital memory unit having a plurality of storage locations for digital coded numbers, each storage location having a specific address designated by a digital coded number, said digital memory having a read output and a write input, said digital memory being connected to said address sequence counter for receiving said sequence of digital coded number addresses and being adapted to connect said each storage location to said read output and said write input in response to the digital coded address for said each storage location;

switch means coupled to said write input of said digital memory unit for presetting and storing numbers and in response thereto generating at least one digital coded number for storage in a specific location in said digital memory unit;

adder means connected to said read output and said write input of said digital memory unit and having means for decrementing said at least one digital coded number stored in said digital memory unit when said at least one digital coded number appears at said read output, said adder means presenting the decremented digital coded number to said write input of said digital memory unit for storage; and display means connected to said write input of said digital memory unit for displaying said decremented digital coded number.

4. The chess clock described in claim 3 wherein said switch means includes:

at least one programmable switch having an enable input and a digital code output, said programmable switch generating a digital code at said output when an enable signal is received at said enable input and having manual controls for determining said digital code output when said programmable switch is enabled; and sequence demultiplexer means connected between said enable input of said at least one programmable switch and said address sequence counter for generating an enable signal to said enable input when the digital code number address designated for said at least one programmable switch is produced by said address sequence counter.

5. A chess clock described in claim 3 wherein said display means comprises:

numeric display means for displaying a multiplicity of number digits; and a display decoder connected between said digital display means and said write input of said digital memory unit for decoding digital coded numbers from said write input for display on said numeric display means.

6. The chess clock described in claim 5 wherein said display means further includes:

a display sequencer connected to said address sequence counter for generating a series of display and enable signals in response to said sequence of digital coded number addresses; and a display driver connected between said display sequencer and said numeric display means for activating specific digit locations of said numeric display means in response to said display enable signals.

7. The chess clock described in claim 3 further including system control means connected to said digital memory unit, to said switch means, to said clock generator, and to said display means, said system control means having a plurality of switches and logic means associated therewith for controlling the functions of said switch means, said digital memory unit, said clock generator, and said display means in a preselected manner including starting, stopping, selecting game type, assigning players to receive switch means preset stored numbers, resetting, and continuing the functions of the clock.

* * * * *